US010421912B2

(12) United States Patent
Bezemer et al.

(10) Patent No.: US 10,421,912 B2
(45) Date of Patent: Sep. 24, 2019

(54) METHOD OF MANUFACTURING HYDROCARBONS

(71) Applicant: SHELL OIL COMPANY, Houston, TX (US)

(72) Inventors: Gerrit Leendert Bezemer, Amsterdam (NL); Harold Boerrigter, Amsterdam (NL); Hai Ming Tan, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 15/756,269

(22) PCT Filed: Sep. 1, 2016

(86) PCT No.: PCT/EP2016/070612
§ 371 (c)(1),
(2) Date: Feb. 28, 2018

(87) PCT Pub. No.: WO2017/037172
PCT Pub. Date: Mar. 9, 2017

(65) Prior Publication Data

US 2018/0291277 A1 Oct. 11, 2018

(30) Foreign Application Priority Data

Sep. 4, 2015 (EP) ..... 15183845

(51) Int. Cl.
*C10G 2/00* (2006.01)

(52) U.S. Cl.
CPC ..... *C10G 2/332* (2013.01); *C10G 2/341* (2013.01)

(58) Field of Classification Search
None
See application file for complete search history.

(56) References Cited

U.S. PATENT DOCUMENTS

| | | | | |
|---|---|---|---|---|
| 4,595,703 | A | 6/1986 | Payne et al. | |
| 8,993,642 | B2 * | 3/2015 | Tanaka | C10G 2/342 518/700 |
| 2005/0154069 | A1 | 7/2005 | Inga et al. | |
| 2009/0124713 | A1 | 5/2009 | Kyasse | |
| 2011/0160510 | A1 | 6/2011 | Claeys et al. | |
| 2012/0202899 | A1 | 8/2012 | Visagie et al. | |

FOREIGN PATENT DOCUMENTS

| | | | |
|---|---|---|---|
| WO | 9700231 | A1 | 1/1997 |
| WO | 2013093428 | A1 | 6/2013 |

OTHER PUBLICATIONS

International Search Report and Written Opinion received for PCT Patent Application No. PCT/EP2016/070612, dated Oct. 7, 2016, 11 pages.

* cited by examiner

*Primary Examiner* — Medhanit W Bahta

(57) ABSTRACT

The invention relates to a method of manufacturing hydrocarbons by operating a Fischer-Tropsch reactor comprising a fixed bed of reduced Fischer-Tropsch catalyst that comprises cobalt as catalytically active metal. Further, the present invention relates to a mixture of hydrocarbons obtainable by said Fischer-Tropsch reaction.

13 Claims, No Drawings

METHOD OF MANUFACTURING HYDROCARBONS

PRIORITY CLAIM

The present application is the National Stage (§ 371) of International Application No. PCT/EP2016/070612, filed 1 Sep. 2016, which claims priority from European Application No. 15183845.5, filed 4 Sep. 2015 incorporated herein by reference.

FIELD OF THE INVENTION

The present invention relates to a method of manufacturing hydrocarbons by operating a Fischer-Tropsch reactor comprising a fixed bed of reduced Fischer-Tropsch catalyst that comprises cobalt as catalytically active metal. Further, the present invention relates to a mixture of hydrocarbons obtained with a Fischer-Tropsch reaction.

BACKGROUND TO THE INVENTION

The Fischer-Tropsch process can be used for the conversion of synthesis gas into liquid and/or solid hydrocarbons. The synthesis gas may be obtained from hydrocarbonaceous feedstock in a process wherein the feedstock, e.g. natural gas, associated gas and/or coal-bed methane, heavy and/or residual oil fractions, coal, biomass, is converted in a first step into a mixture of hydrogen and carbon monoxide. This mixture is often referred to as synthesis gas or syngas. The synthesis gas is then fed into a reactor where it is converted in one or more steps over a suitable catalyst at elevated temperature and pressure into paraffinic compounds and water in the actual Fischer-Tropsch process. The obtained paraffinic compounds range from methane to high molecular weight molecules. The obtained high molecular weight molecules can comprise up to 200 carbon atoms, or, under particular circumstances, even more carbon atoms. Numerous types of reactor systems have been developed for carrying out the Fischer-Tropsch reaction. For example, Fischer-Tropsch reactor systems include fixed bed reactors, especially multi-tubular fixed bed reactors, fluidised bed reactors, such as entrained fluidised bed reactors and fixed fluidised bed reactors, and slurry bed reactors such as three-phase slurry bubble columns and ebulated bed reactors.

Catalysts used in the Fischer-Tropsch synthesis often comprise a carrier-based support material and one or more metals from Group 8-10 of the Periodic Table of Elements, especially from the cobalt or iron groups, optionally in combination with one or more metal oxides and/or metals as promoters selected from zirconium, titanium, chromium, vanadium and manganese, especially manganese. Such catalysts are known in the art and have been described for example, in the specifications of WO 9700231A and U.S. Pat. No. 4,595,703.

The hydrocarbon product stream obtained after the Fischer-Tropsch synthesis comprises mainly paraffinic compounds ranging from methane to high molecular weight molecules. Of this range of products the lighter part (i.e. methane (C1) to butane (C4)) are the least desired products and the heavier part the more desired part of the product stream. Most valued are the hydrocarbons ranging from C5 to C40 (C indicating the carbon chain length). The lighter part of the product stream is normally recovered from the product stream as tail gas and can be reused upstream of the Fischer-Tropsch process (for example in the synthesis gas production).

There are several ways known to improve the yield of the intermediate part of the product stream obtained from a Fischer-Tropsch reaction. It is possible to change the catalyst formulation and select a catalyst with an improved yield to this desired part of the product stream. Once the catalyst has been selected the distribution is fixed for a large extent. Moreover, even with the same catalyst a relative small change is possible by varying the concentration of CO, H2 and inert in the gaseous stream towards the reactor. Finally it is possible to change the operating temperature of the catalyst. There is a continuing desire in the art to improve the Fischer-Tropsch process, especially to tune the product distribution for a given catalyst during its use.

SUMMARY OF THE INVENTION

It is an object of the present invention to provide an improved Fischer-Tropsch process in which a cobalt catalyst is used that has a relatively high initial activity. Especially the way of improving the yield of the heavier fraction is improved.

It has now been found that by adding a nitrogen containing compound to the syngas stream the hydrocarbon chain length distribution of the product stream can be influenced such that the distribution can be optimized to the most desired hydrocarbons.

Accordingly, the present invention provides for a method for manufacturing hydrocarbons by operating a Fischer-Tropsch reactor comprising a fixed bed of reduced Fischer-Tropsch catalyst that comprises cobalt as catalytically active metal, wherein the method comprises the steps of:

a) supplying a gaseous feed stream comprising carbon monoxide and hydrogen to the reactor;

b) converting carbon monoxide and hydrogen supplied with the gaseous feed stream to the reactor into hydrocarbons at an initial reaction temperature;

c) obtaining an initial hydrocarbon stream from the Fischer-Tropsch reactor;

d) optionally, determining the concentration of hydrocarbons having a chain length of at least 41 carbons (C41+) in the initial hydrocarbon stream obtained in step c), being the initial C41+ concentration;

e) adding to the gaseous feed stream a nitrogen-containing compound other than molecular nitrogen such that the nitrogen-containing compound is present in the gaseous feed stream in a concentration of up to 10 ppmV;

f) obtaining, during and/or after addition of the nitrogen-containing compound, a further hydrocarbon stream from the Fischer-Tropsch reactor having a second C41+ concentration which is less than the initial C41+ concentration; and wherein the second C41+ concentration is at least 5% less than the initial C41+ fraction.

Accordingly, the invention further provides for a mixture of hydrocarbons obtained with a Fischer-Tropsch synthesis wherein the concentration of C41+ hydrocarbons is maximally 30 w % based on the total weight of the mixture.

DETAILED DESCRIPTION OF THE INVENTION

The method according to the invention is a method for operating a Fischer-Tropsch reactor. The reactor comprises a fixed bed of reduced Fischer-Tropsch catalyst present in at least one reactor tube. The catalyst comprises cobalt as catalytically active metal.

The catalyst may be a fresh catalyst or a rejuvenated catalyst. Reference herein to a fresh catalyst is to a freshly prepared catalyst that has not been subjected to a Fischer-Tropsch process. Reference herein to a rejuvenated catalyst is to a regenerated catalyst of which the initial activity has been at least partially restored, typically by means of several reduction and/or oxidation steps. The catalyst is preferably a fresh catalyst, since in particular fresh catalysts have a very high initial activity.

The catalyst comprises cobalt as catalytically active metal. Fischer-Tropsch catalysts comprising cobalt as catalytically active metal are known in the art. Any suitable cobalt-comprising Fischer-Tropsch catalysts known in the art may be used. Typically such catalyst comprises cobalt on a carrier-based support material, optionally in combination with one or more metal oxides and/or metals as promoters selected from zirconium, titanium, chromium, vanadium and manganese, especially manganese. A most suitable catalyst comprises cobalt as the catalytically active metal and titania as carrier material.

The catalyst may further comprise one or more promoters. One or more metals or metal oxides may be present as promoters, more particularly one or more d-metals or d-metal oxides. Suitable metal oxide promoters may be selected from Groups 2-7 of the Periodic Table of Elements, or the actinides and lanthanides. In particular, oxides of magnesium, calcium, strontium, barium, scandium, yttrium, lanthanum, cerium, titanium, zirconium, hafnium, thorium, uranium, vanadium, chromium and manganese are suitable promoters. Suitable metal promoters may be selected from Groups 7-10 of the Periodic Table of Elements. Manganese, iron, rhenium and Group 8-10 noble metals are particularly suitable as promoters, and are preferably provided in the form of a salt or hydroxide.

The promoter, if present in the catalyst, is typically present in an amount of from 0.001 to 100 parts by weight per 100 parts by weight of carrier material, preferably 0.05 to 20, more preferably 0.1 to 15. It will however be appreciated that the optimum amount of promoter may vary for the respective elements which act as promoter.

A suitable catalyst comprises cobalt as the catalytically active metal and zirconium as a promoter. Another most suitable catalyst comprises cobalt as the catalytically active metal and manganese and/or vanadium as a promoter. If the catalyst comprises cobalt as the catalytically active metal and manganese and/or vanadium as promoter, the cobalt: (manganese+vanadium) atomic ratio is advantageously at least 12:1.

References to "Groups" and the Periodic Table as used herein relate to the new IUPAC version of the Periodic Table of Elements such as that described in the 87th Edition of the Handbook of Chemistry and Physics (CRC Press).

In operating the reactor according to the present invention the catalyst is a reduced catalyst. In a reduced catalyst the cobalt is essentially in its metallic state. The reactor may be provided with a fixed bed of reduced catalyst by reducing a fixed bed of catalyst precursor in-situ, i.e. in the same reactor wherein the Fischer-Tropsch hydrocarbon synthesis will take place, or by loading the reactor with a reduced catalyst that has for example be prepared by reducing a catalyst precursor in a separate vessel or reactor prior to loading the reduced catalyst in the reactor. Preferably the reactor is provided with a fixed bed of reduced catalyst by reducing a fixed bed of catalyst precursor in-situ.

Reference herein to a catalyst precursor is to a precursor that can be converted into a catalytically active catalyst by subjecting the precursor to reduction, usually by subjecting the precursor to hydrogen or a hydrogen-containing gas using reducing conditions. Such reduction step is well-known in the art.

In step a), a gaseous feed stream comprising carbon monoxide and hydrogen to a reactor. This feed stream or gas mixture is also referred to as syngas or synthesis gas.

The synthesis gas is then fed into a Fischer-Tropsch reactor where, in step b), it is contacted with the Fischer-Tropsch catalyst and the hydrogen and carbon monoxide are converted into hydrocarbons. In step b) the conversion of carbon monoxide and hydrogen supplied with the gaseous feed stream to the reactor into hydrocarbons takes place at an initial reaction temperature. Reference herein to the reaction temperature is to the temperature of coolant, typically cooling water, surrounding the reactor tube containing the fixed bed of catalyst.

The initial temperature preferably is set at least 200° and preferably at maximally 250° C. and hydrocarbons are produced at a first yield (reactor productivity). The reaction temperature may be in the range of 200 to 230° C. and preferably from 205 to 220° C.

In step c) an initial hydrocarbon stream is obtained. The first yield exits the reactor as an initial hydrocarbon stream. Reference herein to yield is to the reactor productivity or space time yield, i.e. to the amount of hydrocarbons produced per volume of catalyst per hour.

The first yield is the desired reactor productivity and is preferably in the range of from 75 to 500 grams hydrocarbons per liter of catalyst per hour, more preferably in the range of from 100 to 350 grams hydrocarbons per liter of catalyst per hour. This productivity is preferably maintained throughout normal operation of the reactor.

As the initial hydrocarbon stream has left the reactor the concentration of hydrocarbons having a chain length of at least 41 carbons (C41+) in the initial hydrocarbon stream is determined. The C41+ concentration of the initial hydrocarbon stream is referred to as the initial C41+ concentration.

Preferably, the initial concentration of the C41+ fraction is at least 40 w %. The weight percent of the C41+ content is based on the total weight of the first hydrocarbon stream.

In order to reduce the C41+ content of the hydrocarbon stream leaving the FT reactor, the present inventors have found that the addition of small amounts of nitrogen containing compounds to the syngas stream fed into the Fischer-Tropsch reactor results in a decrease in C41+ content. I.E. the addition of a nitrogen containing compound to the syngas stream results in a decrease in C41+ selectivity of the FT catalyst. Preferably the selectivity is reduced such that the second C41+ concentration is minimally 5 w % less than the initial C41+ fraction. Said decrease in C41+ concentration is achieved by the continuous supply of the nitrogen containing compound to the syngas stream. With continuous supply is meant the addition of the nitrogen containing compound such that the concentration in the syngas stream may vary, be constant, increase or decrease.

The supply of nitrogen containing compound is continued at least till the C41+ concentration is decreased with at least 5 w %. With decrease is meant that the difference between the content in weight percent of C41+ in the initial stream and the content in weight percent of C41+ in the second stream. With weight percent is in this context meant the weight percent of C41+ with respect to the respective streams.

Optionally after obtaining an initial hydrocarbon stream the C41+ content of this stream can be determined. Determining the C41+ content can be achieved by analyzing a sample of this stream with chromatographic methods such as high temperature gas chromatography or distillation.

Determination of the C41+ content can also be done indirectly be determining the concentration of the other fractions present in the hydrogen stream.

In case the Fischer-Tropsch reactor produces reproducibly an initial hydrocarbon stream with an initial C41+ content, determination of the C41+ content may be omitted. Hence, also based on experience with a Fischer-Tropsch reactor and/or catalyst the amount of nitrogen added to the gaseous feed stream can be determined. Further, the initial C41+ content can also be established by simulation on a computer. In case of obtaining an initial C41+ content based on simulation step d) may be omitted.

After obtaining the initial hydrocarbon stream in step c) and optionally determination of the C41+ content in step d), a nitrogen-containing compound other than molecular nitrogen is added to the gaseous feed stream, such that the nitrogen-containing compound is present in the gaseous feed stream in a concentration of up to 10 ppmV.

Hence, if the C41+ content is known without analyzing the contents of the initial hydrocarbon stream, the nitrogen containing compound can be added to the syngas stream.

Hence in step f) a further hydrocarbon stream from the Fischer-Tropsch reactor having a second C41+ concentration which is less than the initial C41+ concentration is obtained, during and/or after addition of the nitrogen-containing compound. The second C41+ concentration is at least 5% less than the initial C41+ fraction. Hence the present invention allows for a reduction of the C41+ content in the Fischer-Tropsch synthesis product.

The inventors have found that the addition of a nitrogen containing compound in the amount of up to 10 ppmV provides for a good selectivity of the catalyst towards the fractions other than the C1-C4 and C41+ fractions. In case the amount of nitrogen containing compounds exceeds 10 ppmV a decrease in activity and C5+ selectivity is observed which is economically disadvantageous for the current process.

Hence after addition of the nitrogen containing compound to the gaseous feed the content of the hydrocarbon stream exiting the FT reactor changes. The hydrocarbon stream having a different content is referred to as the further hydrocarbon stream and the C41+ content of this stream the second C41+ content.

The present invention also allows for rapidly changing the product slate of the Fischer-Tropsch reactor based on market demand. I.E. in case demand for the C5-C40 fraction increases the output of the Fischer-Tropsch reactor can be changed by adding nitrogen containing compounds to the gaseous feed gas.

The conversion of carbon monoxide and hydrogen into hydrocarbons in the process according to the present invention may be carried out at any reaction pressure and gas hourly space velocity known to be suitable for Fischer-Tropsch hydrocarbon synthesis. Preferably, the reaction pressure is in the range of from 10 to 100 bar (absolute), more preferably of from 20 to 80 bar (absolute). The gas hourly space velocity is preferably in the range of from 500 to 25,000 h-1, more preferably of from 900 to 15,000 h-1, even more preferably of from 1,300 to 8,000 h-1. Preferably, the reaction pressure and the gas hourly space velocity are kept constant.

The nitrogen-containing compound may be any nitrogen-containing compound other than molecular nitrogen that is gaseous under the process conditions applied. Examples of suitable nitrogen-containing compounds are ammonia, HCN, NO, amines, organic cyanides (nitriles), or heterocyclic compounds containing at least one nitrogen atom as ring member of a heterocyclic ring. Preferably, the nitrogen-containing compound is a compound selected from ammonia, HCN, NO, amines, nitriles, and a heterocyclic compound containing at least one nitrogen atom as ring member of a heterocyclic ring and preferably ammonia, HCN, NO or an amine. Preferred amines include amines with one or more alkyl or alcohol groups having up to five carbon atoms. More preferably, the amine is a mono-amine. Examples of especially preferred amines include trimethylamine, dipropylamine, diethanolamine, and methyl-diethanolamine. A particularly preferred nitrogen-containing compound is ammonia.

Preferably, the nitrogen-containing compound other than molecular nitrogen is added to the gaseous feed stream such that the nitrogen-containing compound is present in the gaseous feed stream in a concentration in the range of 0.05 to 10 ppmV.

During operation of the method according to the present invention the following steps may additionally be performed:

g) determining the concentration of hydrocarbons having a chain length of at least 41 carbons (C41+) in the further hydrocarbon stream obtained in step f), being the further C41+ concentration;

h) increasing, decreasing or maintaining the amount of nitrogen-containing compound added to the gaseous feed stream, based on concentration of hydrocarbons having a chain length of at least 41 carbons (C41+) in the further hydrocarbon stream obtained in step g).

Due to changing circumstances in the reactor due to for example the aging of the FT catalyst, the content of the hydrocarbon stream may change. In order to compensate for this change the amount of nitrogen containing compounds in the gaseous feed stream may be adjusted in order to maintain or adjust the C41+ content in the hydrocarbon stream.

In an embodiment of the invention the second C41+ concentration is less than 30 w % of the total second hydrocarbon stream. In case necessary the C41+ content may be reduced to 30 w % or lower based on the total weight of the hydrocarbon stream obtained in step f).

During the progression of the method according the present invention steps g) and h) may be repeated as often as necessary to regulate the output of the Fischer-Tropsch reactor. In case in steps g) a C41+ content is determined step h) may be executed in order to decrease or maintain the C41+ concentration. Preferably steps g) and h) are repeated until the C41+ content is at least 5% less than the initial C41+ content. Optionally, step d) and step e) and steps g) and h) may be repeated until the concentration of the C41+ fraction no longer decreases i.e. until a minimum of the C41+ concentration is reached.

Preferably steps g) and h) are repeated until the C41+ content reaches a value of less than 30 w %. Optionally, step d) and step e) and steps g) and h) may be repeated until the concentration of the C41+ fraction no longer decreases i.e. until a minimum of the C41+ concentration is reached.

The invention further provides for a mixture of hydrocarbons obtained with a Fischer-Tropsch reaction wherein the concentration of C41+ hydrocarbons is maximally 30 w % based on the total weight of the mixture. Preferably the C5-C41 fraction is at least 60 w % based on the total weight of the mixture. These hydrocarbon mixtures are often referred to as Fischer-Tropsch waxes and contain very little contaminants contrary to hydrocarbon mixtures obtained from oil. Preferably, these mixtures according to the invention are obtained by the process according to the invention.

The invention is illustrated by the following non-limiting examples.

EXAMPLES

In general the following experiments were conducted as follows.

A cobalt-based Fischer-Tropsch catalyst was loaded in a reactor tube and reduced. The initial reaction was set such that the resulting space time yield (STY) was 200 grams hydrocarbon products per liter catalyst per hour. The reaction temperature thus set was 220° C. The STY was maintained at a value of 200 g/l.h. and the pressure of the syngas was 60 bar.

Experiment 1 (Invention)

Experiment 1 was conducted as described above with the exception that ammonia was added to the syngas stream fed into the reactor at an amount of 4.4 ppm. The reaction temperature was kept at 220° C. and the STY was 201 g/l.h.

Experiment 2 (Comparative Example)

In Experiment 2 no ammonia was added to the syngas stream provided to the reactor. The reaction temperature was kept at 210° C. and the STY was 206 g/l.h.

The results obtained in experiment 1 and 2 are listed in table 1. The content is expressed in weight percent based on the total content of the product stream exiting the reactor. The fractions are classified and identified by their hydrocarbon chain lengths per fraction.

TABLE 1

| | Content (wt %) | |
|---|---|---|
| Fraction | Experiment 1 | Experiment 2 |
| C1-C4 | 8.3 | 7.9 |
| C5-C40 | 63.3 | 46.6 |
| C41+ | 28 | 45 |

The results show a clear increase in the concentration of the C5 to C40 fractions from 46.6 w % to 63.3 w %. Hence a clear increase in selectivity towards C5-C40 hydrocarbons is observed.

While the invention has been described in terms of what are presently considered to be the most practical and preferred embodiments, it is to be understood that the disclosure need not be limited to the disclosed embodiments. It is intended to cover various modifications, combinations and similar arrangements included within the spirit and scope of the claims, the scope of which should be accorded the broadest interpretation so as to encompass all such modifications and similar structures. The present disclosure includes any and all embodiments of the following claims.

It should also be understood that a variety of changes may be made without departing from the essence of the invention. Such changes are also implicitly included in the description. They still fall within the scope of this invention. It should be understood that this disclosure is intended to yield a patent covering numerous aspects of the invention both independently and as an overall system and in both method and apparatus modes.

Any patents, publications, or other references mentioned in this application for patent are hereby incorporated by reference. In addition, as to each term used, it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans.

That which is claimed is:

1. A method for manufacturing hydrocarbons by operating a Fischer-Tropsch reactor comprising a fixed bed of reduced Fischer-Tropsch catalyst that comprises cobalt as catalytically active metal, said method comprising the steps of:

a) supplying an initial gaseous feed stream comprising carbon monoxide and hydrogen to the reactor;

b) converting carbon monoxide and hydrogen supplied with the initial gaseous feed stream to the reactor into hydrocarbons at an initial reaction temperature;

c) obtaining an initial hydrocarbon stream from the Fischer-Tropsch reactor;

d) adding to a further gaseous feed stream a nitrogen-containing compound selected from the group consisting of ammonia, HCN, NO, amines, nitriles, and a heterocyclic compound containing at least one nitrogen atom as a ring member of a heterocyclic ring and combinations thereof, such that the nitrogen-containing compound is present in the further gaseous feed stream in a concentration of up to 10 ppmV;

e) obtaining, during and/or after addition of the nitrogen-containing compound, a further hydrocarbon stream from the Fischer-Tropsch reactor having a second C41+ concentration which is less than an initial C41+ concentration in the initial hydrocarbon stream; and wherein the second C41+ concentration is at least 5% less than the initial C41+ concentration of the initial hydrocarbon stream.

2. A method according to claim 1, wherein the second C41+ concentration is at least 10% less than the initial C41+ concentration.

3. A method according to claim 1, wherein the nitrogen-containing compound is present in the further gaseous feed stream in a concentration in the range of 0.05 to 10 ppmV.

4. A method according to claim 1, wherein the method further comprises the steps of:

f) determining the concentration of hydrocarbons having a chain length of at least 41 carbons (C41+) in the further hydrocarbon stream obtained in step e), being the further C41+ concentration;

g) increasing, decreasing or maintaining the amount of the nitrogen-containing compound added to the further gaseous feed stream, based on concentration of hydrocarbons having a chain length of at least 41 carbons (C41+) in the further hydrocarbon stream obtained in step f).

5. A method according to claim 4, wherein steps f) and g) are repeated until the concentration of the further C41+ hydrocarbons is at least 5% less than that of the initial C41+ concentration.

6. A method according to claim 1, wherein the nitrogen-containing compound is a compound selected from the group consisting of ammonia, HCN, NO, an amine and combinations or two or more thereof.

7. A method according to claim 1, wherein the nitrogen-containing compound is ammonia.

8. A method according to claim 1, wherein the initial reaction temperature is in the range of 200 to 230° C.

9. A method according to claim 1, wherein the second C41+ concentration is less than 30 w % based on the total weight of the hydrocarbon stream obtained in step e).

10. A method according to claim 1 wherein the initial C41+ concentration is at least 40 w % based on the weight of the initial hydrocarbon stream obtained in step c).

11. A method according to claim 1 wherein the second C41+ concentration is at least 15% less than the initial C41+ fraction.

12. A method according to claim 1, further comprising the step of determining the concentration of hydrocarbons having a chain length of at least 41 carbons (C41+) in the initial hydrocarbon stream obtained in step c), being the initial C41+ concentration.

13. A method according to claim 1, wherein the initial reaction temperature is in the range of 205 to 220° C.

* * * * *